United States Patent [19]

Andrews et al.

[11] 4,173,997

[45] Nov. 13, 1979

[54] MODULAR STEAM GENERATOR

[75] Inventors: Harry N. Andrews, Export, Pa.; Robert F. Barry, St. Genese, Belgium

[73] Assignee: Westinghouse Electric Corp., Pittsburgh, Pa.

[21] Appl. No.: 771,140

[22] Filed: Feb. 23, 1977

[51] Int. Cl.[2] ..... F28F 3/00

[52] U.S. Cl. ..... 165/158; 122/32; 176/65

[58] Field of Search ..... 176/64, 65; 165/158, 165/9; 122/32, 34

[56] References Cited

U.S. PATENT DOCUMENTS

| | | | |
|---|---|---|---|
| 1,733,993 | 10/1929 | Grace | 165/83 |
| 3,162,177 | 12/1964 | Loew et al. | 122/32 |
| 3,850,231 | 11/1974 | Creek | 165/83 |
| 3,868,994 | 3/1975 | Petrek | 122/34 |

*Primary Examiner*—Charles J. Myhre
*Assistant Examiner*—Theophil W. Streule, Jr.
*Attorney, Agent, or Firm*—F. J. Baehr, Jr.

[57] ABSTRACT

Modular bundles of U-shaped tubes having primary fluid conduits with compression seals which cooperate with a pair of transversely disposed parallel support plates to allow removal and replacement of the modular tube bundles to facilitate maintenance and extend steam generator life in pressurized water reactors.

16 Claims, 3 Drawing Figures

MODULAR STEAM GENERATOR

BACKGROUND OF THE INVENTION

This invention relates to steam generators and more particularly to steam generators having modular tube bundles which can be removed and replaced to facilitate maintenance of the tubes in the steam generator.

Steam generators for pressurized water reactor power plants have been designed and constructed with a single large bundle of approximately 4,000 U-shaped tubes and arranged in such a manner that the outer periphery of the bundle is generally circular conforming to the shape of the cylindrical shell. The tubes are so disposed that one end of the tubes are located on one side of a tube sheet while the other end of the tubes are located on the other side of the tube sheet. A channel head forms headers through which primary fluid, hot pressurized water from the reactor, flows through the tubes to heat and boil secondary fluid or feedwater, which is supplied to the inner shell of the steam generator passing over the outside of the tube. Blowdown lines are provided to allow part of the secondary water to be drawn off to facilitate maintaining a balance chemical makeup and special materials are utilized in forming the tubes to provide a long life for the heat exchanger. However, leaks develop due to erosion or corrosion or a combination of the two. To provide separation of the primary secondary fluid the leaky tubes are plugged. While plugging a single tube results in only a small incremental and insignificance loss in performance of the steam generator, degradation of a large number of tubes from chemical action or mechanical wear by the support plates may eventually result in a significant loss performance. Therefore, replacement of large number of tubes would necessitate massive disassembly of the steam generator.

SUMMARY OF THE INVENTION

In general a heat exchanger for transferring heat from a primary fluid to vaporize a secondary fluid, made in accordance with this invention, comprises a vertically oriented shell portion, a lower head and an upper head forming end closures for the shell. A first transversely disposed plate is located in the shell forming two compartments therein one of the compartments having inlet and outlet nozzles for the primary fluid and the other compartment having inlet and outlet nozzles for the secondary fluid. A second transversely disposed plate is located parallel to the first transversely disposed plate and within the compartment having the primary fluid nozzles and separates the primary fluid inlet nozzle from the primary fluid outlet nozzle. A plurality of modular tube bundles are also disposed within the shell. Each tube bundle has a plurality of generally U-shaped tubes forming a hot leg portion, a tube sheet into which the ends of the tubes are secured, a pair of headers one serving as an inlet header and the other serving as an outlet header, and conduits in fluid communication with each of the headers. The transversely disposed plates have registering openings through which the conduits in communication with the headers pass and form a seal therewith, whereby primary fluid flows in series through the primary fluid inlet nozzle, one of the conduits, the tubes, the other conduit, and then through the primary fluid outlet nozzle. The steam generator also comprises a compartment for transmitting secondary fluid from the secondary fluid inlet nozzles to at least the cold leg portion of the tube bundles adjacent the tube sheet whereby the secondary fluid flows upwardly over the outside of the tubes and is vaporized and the vapor flows to the secondary fluid outlet nozzle.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
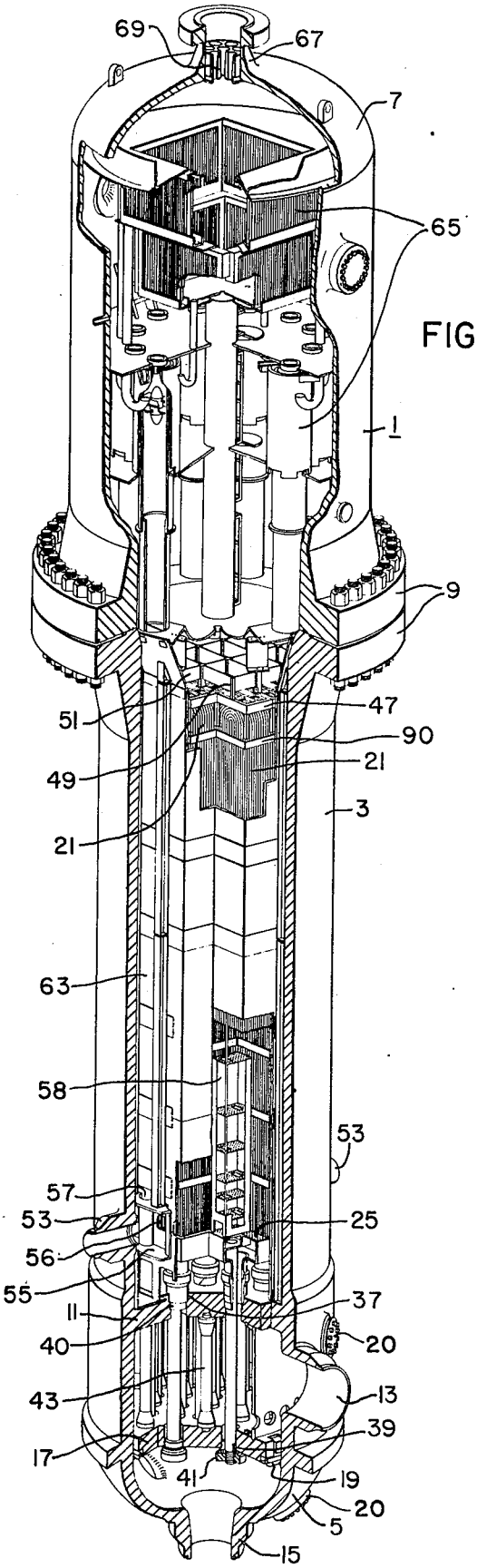
FIG. 1 is a perspective view partially in section showing a steam generator made in accordance with this invention.

Referring now to the drawings in detail and in particular to FIG. 1 there is shown a steam generator 1 for transferring heat from a primary fluid to boil or vaporize a secondary fluid and having a vertically oriented shell portion 3, a hemispherical head portion 5 forming the lower end closure, and an elliptical head portion 7 forming the upper end closure. A pair of bolted well neck flanges 9 are disposed in the shell allowing easy access to the internals of the steam generator. The flanges 9 also serve as a transition member as the upper portion of the shell 3 is slightly larger in diameter than the lower portion.

A first transversely disposed plate 11 is located in the lower end of the shell 3 and is welded thereto or made integral therewith. The first plate 11 separates the shell into two separate compartments. One of the compartments having a primary fluid inlet nozzle 13 in the side wall and a primary fluid outlet nozzle 15 centrally disposed in the hemispherical head 5 forms the primary fluid compartment or chamber.

A second transversely disposed plate 17 is located in the primary fluid chamber parallel to the first plate 11 and separates the primary fluid inlet nozzle 13 from the primary fluid outlet nozzles 15. A seal 19 is disposed between the periphery of the second plate 17 and the shell 3 to prevent flow adjacent the periphery of the plate 17. A separate manway 20 is disposed in each portion of the primary fluid chamber.

A plurality of modular tube bundles 21 having a plurality of generally U-shaped tubes are disposed in the shell above the first plate 11. Each modular tube bundle 21 comprises a rectangular tube sheet 25 having a plurality of holes 27 into which ends of the tubes 23 are expanded and welded. The tubes 23 are arranged so that one end of the tubes are disposed in holes 27 located on one side of the tube sheet 25, while the other ends of the tubes 23 are located in holes 27 disposed on the other side of the tube sheet 25. Rectangular shaped headers 28 and 29 are provided for each group of tube ends so that the primary fluid flows through the tubes forming a hot leg portion 32 on the influent side and a cold leg portion 33 on the effluent side of the tube bundles 21. The header 29 extends to the edges of the tube sheet 25 and also encloses the header 28 which is disposed totally within the confine of the header 29. The tubes 23 adjacent the outer periphery of the tube sheet are offset to provide space for the side walls of the header 29 and to allow the tube bundles to be packed together tightly and provide optimum spacing between the tubes extending from the tube sheet.

Conduits 34 and 35 are disposed in fluid communication with the headers 28 and 29, respectively and conduit 34 passes axially through conduit 35. The transversely disposed plates 11 and 17 having openings 37 and 39, respectively, the openings 37 are adapted to receive the conduit 35 and cooperate with a compressive seal 40 to form a seal between the conduit and the opening. The openings 39 in the plate 17 are smaller and the conduit 34 extends through the openings 39. The ends of the conduit 34 are threaded and nuts 41 are screwed on the thread compressing a compression seal disposed between the conduit 35 and the opening 39 in the plate 17. Spacers 43 are provided between the plates 11 and 17 so that tighting the nut 41 also compresses the compression seal 40 disposed between the opening 37 and the conduit 35. The nut 41 supplies the necessary sealing force and secures the lower end of the tube bundle 21 in place within the shell 3.

Stay rods 41 extend the length of the tube bundle 21 and are attached to vertically spaced grids 90 which radially restrain and support the tubes 23, as well as to a rectangular shaped separator grid 47 which maintains the modular shape and provides sufficient structural rigidity so that the modular tube bundles may be lifted by a crane. Extended upwardly from the separator grids 47 are dowel pins 49 which register with openings in a tube bundle support assembly 51 which is attached to the shell 3 and stabilizes and positions the upper end of the tube bundles 21.

Secondary fluid or feedwater inlet nozzles 53 are disposed in the lower end of the shell above the first transversely disposed plate 11 on opposite sides of the shell 3. Feedwater inlet chambers 55 are disposed in fluid communication with the feedwater inlet nozzles 53 and have a plurality of openings 56 disposed therein to supply feedwater to the tube bundles 21. Channels 57 are also disposed in the feedwater inlet chamber to allow recirculating water to pass through the chamber without mixing with the feedwater.

Figure 3:
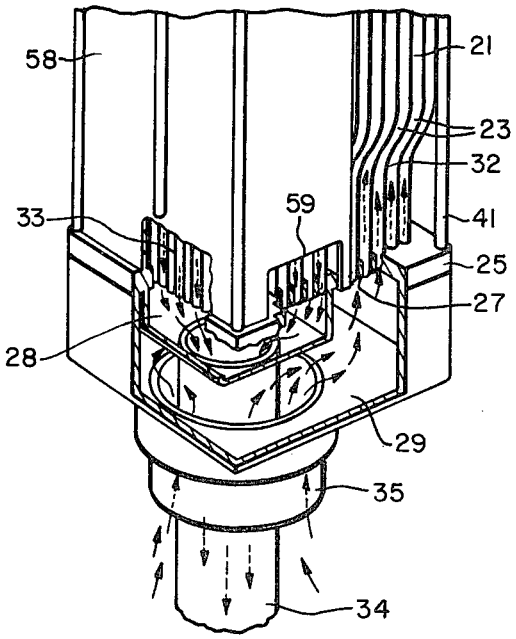
FIG. 3 is an enlarged partial perspective view of a tube bundle showing the primary fluid headers and connecting conduits.
Figure 2:
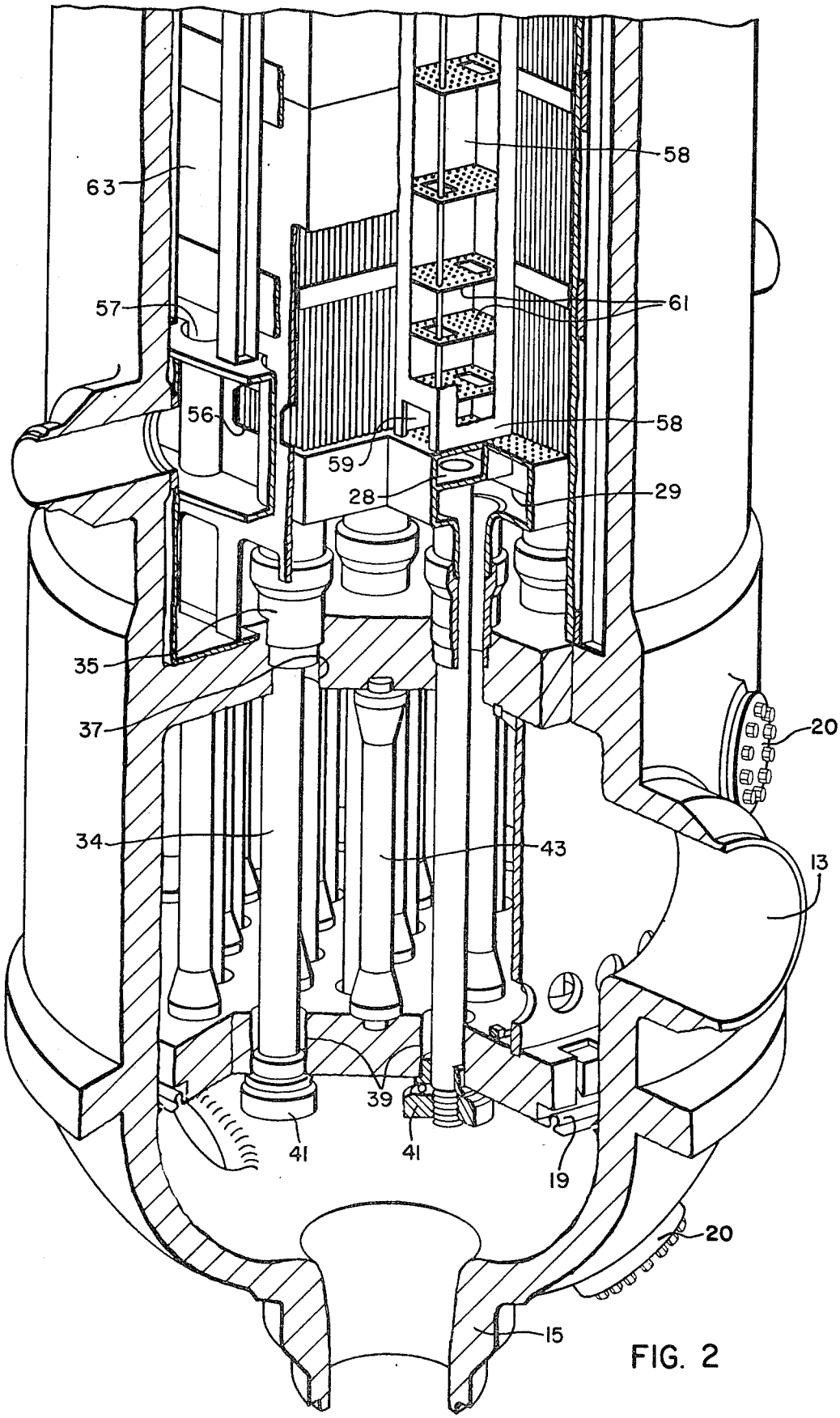
FIG. 2 is an enlarged partial perspective view partially in section showing a portion of a steam generator made in accordance with this invention.

As shown in FIGS. 2 and 3 the cold leg portion of each tube bundle has a rectangular shaped skirt or wrapper 58 extending upwardly from the tube sheet 25. The skirt 58 has openings 59 on opposite sides which register with the openings 59 in adjacent tube bundle skirts 58 and with opening 56 in the feedwater inlet chamber 55 in order to direct the feedwater to the cold leg portions of the tube bundles. A plurality of baffles 61 are disposed within the skirt 58 to form a preheater section in each tube bundle 21. A wrapper 63 surrounds the tube bundle 21 producing a space adjacent the shell 3.

Two stages of moisture separating means 65 are disposed in the upper portion of the shell 3 generally above the flange 9 and a secondary fluid or steam outlet nozzle 67 is centrally disposed in the elliptical head 7. A cluster of venturis 69 are disposed within the steam outlet nozzle 67 to limit the flow in case of a pipe break accident.

The operation of the steam generator is as follows: primary fluid enters the primary fluid inlet nozzle 13 in the compartment between the transversely disposed plates 11 and 17 and then flows through conduits 35 associated with each tube bundle 21 into the headers 29 where the primary fluid is distributed to the tubes 23. The primary fluid then passes through the tubes 23 forming a hot leg portion 32 as it enters therein and then a cold leg portion 33 prior to be discharged from the tubes 23 into the headers 28. From the headers 28 the primary fluid flows through the conduits 34 into a chamber below the transversely disposed plate 17 and is discharged through the primary fluid outlet nozzles 15 centrally disposed in the hemispherical head 5.

Secondary fluid or feedwater enters a pair of feedwater inlet nozzles 53 disposed on opposite sides of the shell 3 and flows to the feedwater inlet chamber 55 where it is distributed through openings 56 disposed therein and in communication with openings 59 in the skirt enwrapping the cold leg portion 33 of the tube bundles 21. The feedwater makes several passes over the cold leg portion 37 of the tube bundles 21 as it is guided by baffles 61 across the outer surface of the tubes 23. The feedwater continues to flow upwardly over the outside of the tubes 23 leaving the upper portion of the skirt 58 at saturated temperature. The saturated liquid continues to flow upwardly over the outside of the tubes 23 boiling or vaporizing as it progresses to the uppermost portion of the tube bundle 21 where all of the secondary fluid is boiled or vaporized to form saturated steam that flows upwardly into the upper portion of the shell and through two stages of moisture separators 65, which remove entrained moisture from the saturated steam. The dry saturated steam or secondary fluid is discharged through the secondary fluid or steam outlet nozzle 67 centrally disposed in the upper portion of the elliptical head 7 on the top of the steam generator 1.

Moisture or water collected by the separators 67 is directed to the space between the wrapper 63 and the shell 3 and is fed downwardly adjacent the shell. As the moisture collected, which is generally at saturated temperature, reaches the lower portion of the shell 3, it is directed over the hot leg portion of the tube sheet 25 and under the headers 28 and 29. Since it is generally at saturation temperature, this water begins to boil or vaporize as it rises over the hot leg portion 32 of the tube bundle 21 admixing with the saturated liquid flowing from the preheater or cold leg portion 33 of the tube bundle 21 and continues to boil and vaporize as it progresses to the upper portion of the tube bundles 21 where it is all converted to saturated steam.

To remove and replace one or more tube bundles 21 the flanges 9 in the shell 3 are broken and the upper portion of the shell 3 is removed. Portions of the moisture separating means 65 is removed along with the upper portion of the shell 3. Other internals are removed exposing the modular tube bundles 21. Nuts 41 on the lower end of the conduits 35 are removed and the tube bundles 21 can be lifted by a crane or other lifting device as the nuts 41 are the only fastening devices which serves the double purpose of holding the tube bundles in place and providing the compression forces necessary to form a seal between the conduits 35 and 34 and the transversely disposed plates 11 and 17. A new or repaired tube bundle 21 can be lowered in place and the nuts 41 on the conduit 34 may be tightened to lock the replaced tube bundle 21 in position and form a compressive seal where the conduits 35 and 34 join the transversely disposed plates 11 and 17, thus providing a steam generator wherein individual modules may be removed independent of adjacent modules and without disturbing the latter.

What is claimed is:

1. A heat exchanger for transferring heat from a primary fluid to vaporize a secondary fluid, said heat exchanger comprising:

an elongated vertically oriented shell portion;

a lower head and an upper head portion forming end closures for said shell;

a first transversely disposed general horizontal plate having a periphery which extends to said shell, and is sealingly affixed thereto and which cooperates with said first plate to form a first compartment having inlet and outlet nozzles for said primary fluid and a second compartment having inlet and outlet nozzles for said secondary fluid;

a second transversely disposed general horizontal plate spaced from said first plate and having a periphery which extends to said shell and having a peripheral seal;

said second plate being so disposed within said first compartment so as to separate said primary fluid inlet nozzle from said primary fluid outlet nozzle;

a plurality of modular tube bundles disposed in said second compartment, each of said tube bundles having a plurality of generally U-shaped tubes forming a hot leg portion and a cold leg portion, a tube sheet into which the ends of the tubes are secured, a pair of headers, one of said headers serving as an inlet header and the other of said headers serving as an outlet header, and conduits in fluid communication with each of said headers;

said transversely disposed plates having registering openings through which at least one of said conduits in communication with one of said headers passes and forms a seal therewith whereby primary fluid flows in series through said primary fluid inlet nozzle one of said conduits, said tubes, the other of said conduits, and then through the primary fluid outlet nozzle; and means for transmitting secondary fluid from the secondary fluid inlet nozzle to at least the cold leg portion of said tube bundles adjacent said tube sheets, whereby the secondary fluid flows upwardly over the outside of said tubes and is vaporized and the vapor flows out through said secondary fluid outlet nozzle.

2. A heat exchanger as set forth in claim 1, wherein the tube bundles generally have a rectangular shaped cross-section.

3. A heat exchanger as set forth in claim 1, and further comprising a wrapper disposed generally parallel to the shell in order to form a space between the wrapper and the shell.

4. A heat exchanger as set forth in claim 3, and further comprising separating means disposed in the shell above the tube bundles to separate liquid from the vaporized secondary fluid.

5. A heat exchanger as set forth in claim 4, and further comprising means for directing the separated liquid to the space between the shell and the wrapper and means for directing the separated liquid to the hot leg portion of the tube bundles.

6. A heat exchanger as set forth in claim 5, and further comprising a skirt enclosing the lower portion of the cold leg portion of each tube bundle, each skirt having a pair of openings adjacent the lower end thereof and a secondary fluid inlet compartment in fluid communication with the secondary fluid inlet nozzle, the secondary fluid inlet chamber having openings which register and cooperate with the openings in the skirts to cause a flow of influent secondary fluid to the cold leg portion of each tube bundle, whereby the influent secondary fluid is generally heated to its saturation temperature as it passes over the outside of the tubes encircled by the skirt.

7. A heat exchanger as set forth in claim 6, wherein the secondary fluid inlet compartment has passages disposed therein for directing separated liquid to the hot leg portion of the tube bundle.

8. A heat exchanger as set forth in claim 1, wherein the shell further comprises a flange joint and the seals between the conduits and the openings in the transversely disposed plates are compression sealed whereby the flange joint in the shell may be broken and a portion of the shell may be removed and the compression joints may be released so that the tube bundles may be removed from the shell for repair and replacement.

9. A heat exchanger as set forth in claim 8, and further comprising a manway in communication with that portion of the primary fluid compartment below the second transversely disposed plate.

10. A heat exchanger as set forth in claim 9, and further comprising means cooperating with said conduit for compressing the seals said compressing means being disposed in the primary fluid compartment below the second transversely disposed plate.

11. A heat exchanger as set forth in claim 10, and further comprising spaces disposed between said transversely disposed plates.

12. A heat exchanger as set forth in claim 1, wherein each tube bundle has a plurality of stay rods extending the length thereof and means for tying said stay rods together at the ends of the tube bundle opposite the tube sheet.

13. A heat exchanger as set forth in claim 12, and further comprising means cooperating with the shell and the tying means for holding the end of the tube bundles opposite the tube sheet in position within the shell.

14. A heat exchanger as set forth in claim 13, wherein the tube bundles generally have a rectangular shaped cross-section.

15. A heat exchanger as set forth in claim 1, wherein some of the generally U-shaped tubes forming each tube bundle have offset ends, whereby the tube bundles may be packed together tightly and the spacing between the tubes may be optimized.

16. A heat exchanger as set forth in claim 1 wherein the individual modules are removable independent of adjacent modules.

* * * * *